US010022604B2

(12) United States Patent
Elpers

(10) Patent No.: US 10,022,604 B2
(45) Date of Patent: Jul. 17, 2018

(54) ARRANGEMENT FOR MOUNTING BASKETBALL GOAL SUPPORT ARMS TO A SUPPORT POLE

(71) Applicant: Indian Industries, Inc., Evansville, IN (US)

(72) Inventor: Philip Elpers, Evansville, IN (US)

(73) Assignee: Indian Industries, Inc., Evansville, IN (US)

( * ) Notice: Subject to any disclaimer, the term of this patent is extended or adjusted under 35 U.S.C. 154(b) by 35 days.

(21) Appl. No.: 14/952,132

(22) Filed: Nov. 25, 2015

(65) Prior Publication Data

US 2017/0144041 A1 May 25, 2017

(51) Int. Cl.
*A63B 63/08* (2006.01)

(52) U.S. Cl.
CPC ..... *A63B 63/083* (2013.01)

(58) Field of Classification Search
CPC ..... A63B 63/083
USPC ..... 473/479–484; 248/219.4
See application file for complete search history.

(56) References Cited

U.S. PATENT DOCUMENTS 2,830,855 A * 4/1958 Hyre ..... E04G 7/304 403/188
3,776,549 A 12/1973 Ganis
3,802,702 A * 4/1974 Pulley ..... A63B 63/083 248/284.1
4,798,381 A 1/1989 Dadbeh
4,881,734 A 11/1989 Nye
5,324,027 A 6/1994 Nye
5,478,068 A 12/1995 Schroeder
5,570,880 A 11/1996 Nordgran
5,720,679 A 2/1998 Schroeder
6,155,938 A 12/2000 Mower
6,283,878 B1 9/2001 White
6,422,957 B1 7/2002 Winter et al.
6,488,599 B2 12/2002 Nye
6,645,095 B1 11/2003 Nye et al.
8,062,152 B2 11/2011 Nye et al.
8,206,247 B2 * 6/2012 Elpers ..... A63B 63/083 473/481
8,348,788 B2 1/2013 Nye et al.
8,708,844 B2 4/2014 Nye et al.
2006/0183574 A1 * 8/2006 Stanford ..... A63B 63/083 473/481

* cited by examiner

*Primary Examiner* — Melba Bumgarner
*Assistant Examiner* — Laura L Davison
(74) *Attorney, Agent, or Firm* — Woodard, Emhardt, Moriarty, McNett & Henry, LLP; Charles Meyer

(57) ABSTRACT

Certain embodiments of the present disclosure describe an arrangement for mounting basketball goal support arms to a support pole. The arrangement includes an attachment assembly that has a bolt piece, spacers, and a locking portion. The bolt piece includes a medial portion and bolt ends. The medial portion may be permanently attached to the support pole of a basketball goal. The bolt ends may receive a spacer, a support arm, and a locking portion.

16 Claims, 4 Drawing Sheets

ARRANGEMENT FOR MOUNTING BASKETBALL GOAL SUPPORT ARMS TO A SUPPORT POLE

FIELD OF THE INVENTION

The present disclosure deals with basketball goal assemblies.

BACKGROUND OF THE INVENTION

Basketball is a popular sport that can be played by anyone who has access to a ball and a basketball goal. Basketball goals have become common to find in driveways and public parks. Often, when these basketball goals are not mounted to a wall, a pole or another similar support structure is used to hold the backboard of the basketball goal at a specified height. The process of assembling the basketball goal may be a difficult task for one person, especially attaching the backboard to a pole. It can be difficult for a single person to support the backboard structure on the pole while attaching support arms that connect the backboard to the pole. Additionally, loose pieces such as bolts may be easily lost or misplaced. Therefore, there is a need for an arrangement that allows easy securement of the support arms of a basketball goal to the support pole.

SUMMARY OF THE INVENTION

Certain embodiments include an arrangement for mounting basketball goal support arms to a support pole. The basketball goal includes a backboard assembly and a support pole. One end of the support pole may be secured to the ground or attached to a base. The backboard assembly is attached to the support pole by a support system that includes support arms that extend between the backboard assembly and the support pole.

The support arms are mounted on the support pole using an attachment assembly. The attachment assembly may include a bolt piece, spacers, and locking pieces. The bolt piece has a medial portion that is positioned between two bolt ends. The shape of the medial portion of the bolt piece may correspond to the shape of the support pole so that the medial portion may wrap around a portion of the support pole. The medial portion of the bolt piece may be permanently fixed to the support pole by a suitable attachment method, such as a weld. The bolt ends extend outward from the support pole to provide attachment points for support arms.

In certain embodiments, multiple attachment assemblies may be attached to the support pole to provide attachment points for multiple pairs of support arms. One of the attachment assemblies may be permanently attached to the front side of the support pole. The other attachment assembly may be permanently attached at the rear of the support pole.

Some embodiments include a method of mounting the support arms of a basketball goal to the support pole of the basketball goal. The medial portion of the bolt piece of an attachment assembly is permanently fixed to the support pole. A spacer is slid onto each of the bolt ends of the bolt piece. Support arms are then placed on each of the respective bolt ends. A locking member is attached to the outer portion of each of the bolt ends, retaining each support arm between a spacer and a locking member.

Further objects, features and advantages of the present invention shall become apparent from the detailed drawings and descriptions provided herein.

DESCRIPTION OF PREFERRED EMBODIMENTS

Figure 1:
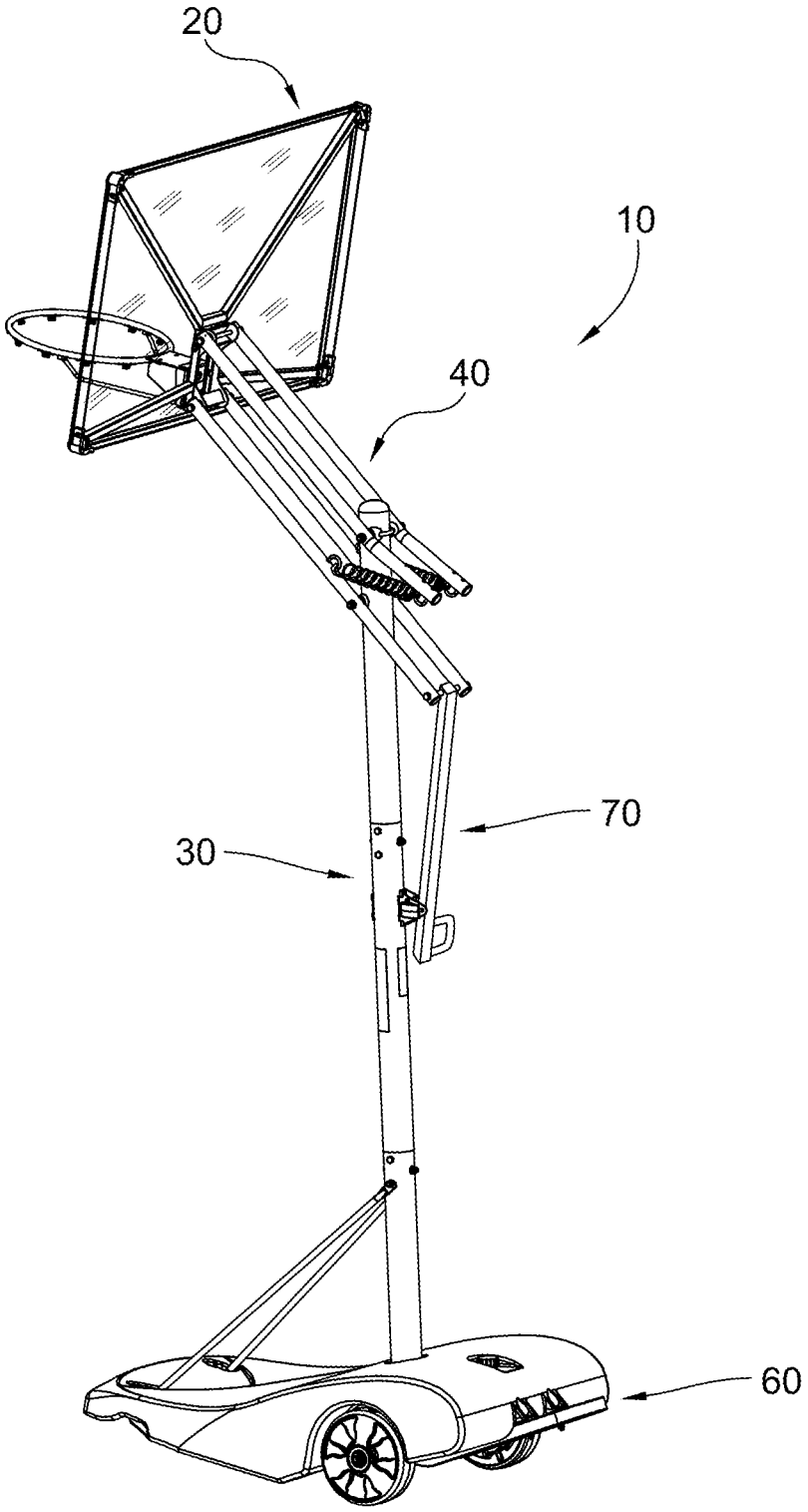
FIG. 1 is a rear perspective view of a basketball goal.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

The present disclosure pertains generally to the field of basketball goals and particularly to support features of basketball goals. Often, a basketball goal includes multiple support arms that extend between a backboard structure and a support pole to connect the backboard structure to the support pole. The support arms are often used in pairs. Traditionally, the corresponding arms are connected by a bolt assembly that extends through the support pole or mounting brackets on the pole. Many basketball hoops require some assembly after they are sold to a consumer. The traditional bolt assemblies for attaching the support arms to the support pole may be loose pieces that can be lost during assembly. Additionally, it may be difficult for a single person to align the bolt assemblies with the support pole and to keep the support arms oriented in the correct positions without help from another person. It is desirable to provide a support system that is pre-attached to the support pole to eliminate the risk of losing pieces and to allow assembly by a single person.

In certain aspects, the present disclosure provides a system for mounting basketball goal support arms to a support member such as a support pole. The basketball goal is arranged to be in a playing position relative to a support surface such as the ground or a floor. The system includes a structure of support arms extending from the basketball backboard and the support pole. Pairs of support arms are respectively pivotally mounted to the support pole using shaped bolt pieces. More specifically, as illustrated, the bolt pieces each include an arcuately shaped middle portion which is shaped to match the surface contour of the support member. The opposing ends of each bolt are axially aligned along a single axis, which is typically parallel to the support surface.

Some embodiments include a pair of lower parallel arms and a pair of upper parallel arms. In use, a bolt piece for the lower parallel arms may be welded in its central portion to the front surface of the support pole. A bolt piece for the upper arms may then be welded to the rear upper portion of the pole. This places the respective axes toward the front edge of the pole and toward the rear edge of the pole. Alternatively, the bolt piece for the lower arms may be welded to the rear side of the pole, and the bolt piece for the upper arms may be welded to the front side of the pole. In yet another embodiment, the bolt pieces for the upper arms and the lower arms may be welded to the same side of the support pole.

During assembly, each parallel arm can be fitted over a corresponding bolt end and then each arm is secured with a lock nut or similar connector. Optionally, a spacer or wedge shaped piece can be placed between the arm and the pole. Advantages of this arrangement include that the bolt pieces can be welded to the support arm prior to shipment to a consumer, eliminating loose bolt pieces. Further, a consumer doesn't need to align one or more bolts, or any other additional pieces, with the parallel arm holes and also pole or bracket holes during assembly.

FIG. 1 representatively illustrates a basketball goal assembly 10. Basketball goal assembly 10 includes a backboard assembly 20 and a support member such as support pole 30. In some embodiments, support pole 30 may be monolithic; however, in other embodiments, support pole 30 may include two or more portions connected together. Support pole 30 may have a curved cross-section such as a circular or oval shape, a rectangular cross-section, or it may have a cross-section of any other desired shape.

Support pole 30 may have a front side and a rear side. The front side of support pole 30 is the side closest to backboard assembly 20, and the rear side is the side that is furthest from the backboard assembly 20, opposite the front side. It is not required that the front and the rear sides are clearly defined by an edge of support pole 30. For example, the front side of a support pole 30 with a circular cross-section is the portion of support pole 30 that faces backboard assembly 20.

The bottom portion of support pole 30 is mounted relative to the support surface, for example by being attached to a base 60. Base 60 may be portable. Support pole 30 may be angled so pole 30 extends obliquely from base 60 relative to the support surface. In some embodiments, base 60 is not required, and pole 30 may be secured directly into the ground or into an alternative base that may or may not be movable.

Figure 2:
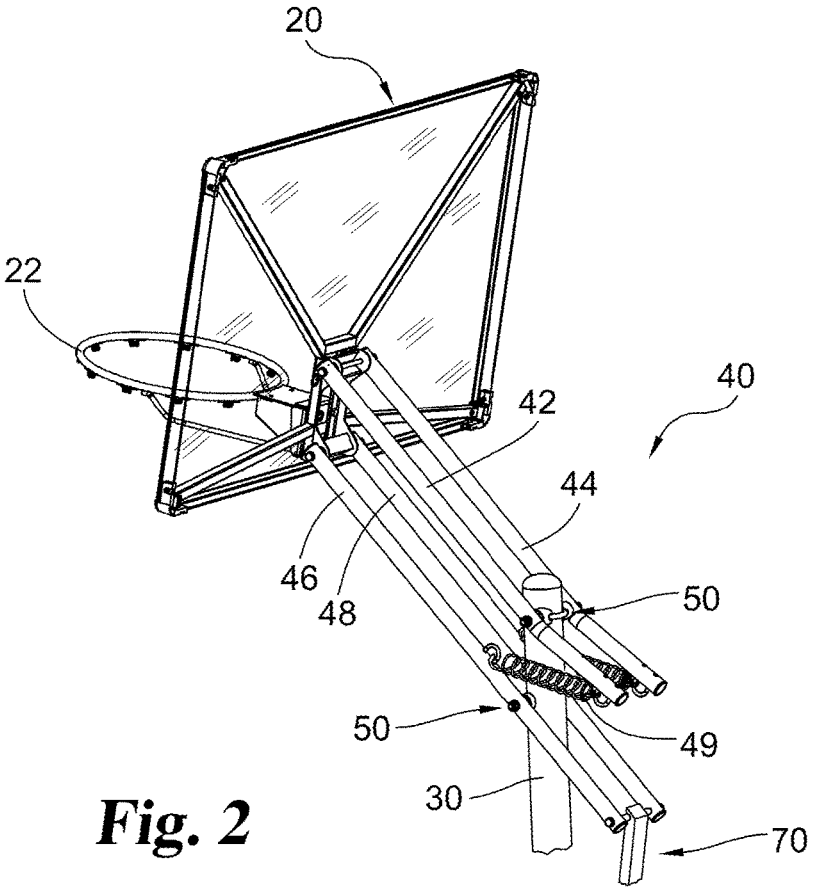
FIG. 2 is a rear perspective view of a backboard assembly and a support system from the basketball goal of FIG. 1.

A support system 40 extends between backboard assembly 20 and the upper portion of support pole 30. As shown in FIG. 2, support system 40 includes at least one and preferably a pair of upper support arms 42, 44 and at least one and preferably a pair of lower support arms 46, 48. Upper support arms 42, 44 extend parallel to each other between backboard assembly 20 and support pole 30. Support arm 42 is located on one side of support pole 30 and support arm 44 is located on the opposite side of support pole 30. Similarly, lower support arms 46, 48 extend parallel to each other between backboard assembly 20 and support pole 30 with each support arm 46, 48 on a corresponding side of support pole 30. The ends of one or more support arms 42, 44, 46, 48 may extend past support pole 30 and may provide attachment points for additional features of basketball goal 10. For example, height adjustment mechanism 70 may be attached between lower support arms 46, 48. A balancing structure, such as springs 49 or weights in or on the support arms, may help keep the backboard weight close to neutrally balanced relative to the pole so that it takes a minimum force applied to the rear of the support arms to raise or lower the backboard.

Support arms 42, 44, 46, 48 may have a square cross-section, a rectangular cross-section, a circular cross-section, or a cross-section of any other desired shape. Some support arms 42, 44, 46, 48 may be tubular, forming a hollow interior portion and some support arms may be a solid tube or plate.

Support arms 42, 44, 46, 48 create a deformable parallelogram assembly for adjusting the backboard height. Support arms 42, 44, 46, 48 may each be pivotally attached to support pole 30 at an attachment assembly 50. An optional Height adjustment mechanism 70 may be used to cause lower support arms 46, 48 to vertically pivot about attachment assembly 50, which in turn causes upper support arms 42, 44 to vertically pivot. Pivoting support arms 42, 44, 46, 48 causes backboard assembly 20 to move either upward or downward, changing the height of basketball rim 22. In the embodiment shown in FIG. 2, pulling downward on height adjustment mechanism 70 causes lower support arms 46, 48 to pivot clockwise about attachment assembly 50, increasing the height of backboard assembly 20. Similarly, pushing upward on height adjustment mechanism 70 causes lower support arms 46, 48 to pivot counterclockwise about attachment assembly 50, decreasing the height of backboard assembly 20.

Figure 3:
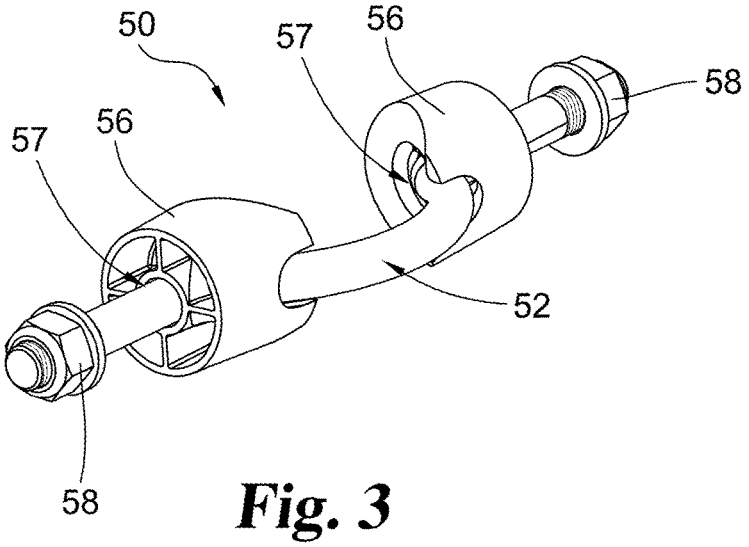
FIG. 3 is a perspective view of an attachment assembly from the support system of FIG. 2.
Figure 4:
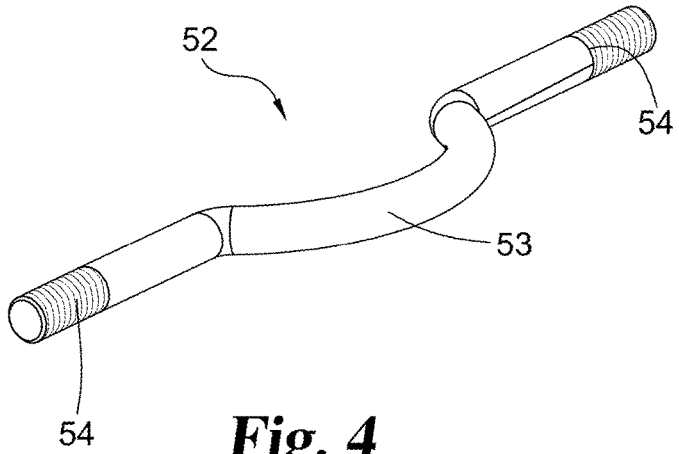
FIG. 4 is a perspective view of a bolt piece from the attachment assembly of FIG. 3.

An example of attachment assembly 50 is shown in greater detail in FIG. 3. Attachment assembly 50 includes a bolt piece 52, optional spacers 56, and locking pieces 58, such as a lock nut, cotter pin, cap, or other suitable form of connector. As shown in FIG. 4, bolt piece 52 includes a medial portion 53 and bolt ends 54. Bolt ends 54 may be axially aligned along a single axis.

In some embodiments, medial portion 53 may be shaped to match the shape of a support member, such as being arcuately curved or C-shaped to correspond to the curvature of support pole 30. However, in other embodiments, it is not required that medial portion 53 is curved. For example, medial portion 53 may be formed in a C-shape with right angle corners to match the shape of a support member with a rectangular cross-section. In other embodiments, the medial portion may be straight and can be mounted to a flat surface of a support member.

Spacers 56 include an opening 57 that allow spacers 56 to be slid onto bolt piece 52. Each spacer 56 may be positioned on a corresponding side of bolt piece 52 near the portion of bolt piece 52 where medial portion 53 joins with bolt end 54. Spacers 56 are sized to leave a sufficient protruding length on bolt ends 54 to allow the width of one of the support arms 42, 44, 46, 48 to fit on bolt end 54 as well as a locking piece 58. The inner surface of spacers 56 may be shaped to correspond with the shape of support pole 30. Although not required, the outer surface of spacers 56 may be vertical or any other shape required to substantially match the shape of a corresponding support arm. Spacers 56 may prevent support arms 42, 44, 46, 48 from binding or rubbing on support pole 30 as the support arms pivot. Optionally, spacers 56 may be used to dampen any force or vibration that is passed through support pole 30 or support arms 42, 44, 46, 48 or to reduce noise. Spacers 56 may also encourage correct alignment of the support arms. Spacers 56 may be made from plastic, a rubber or foam material, a self-lubricating material such as DELRIN®, metal, or any other material that may effectively separate support arms 42, 44, 46, 48 from support pole 30.

Figure 5:
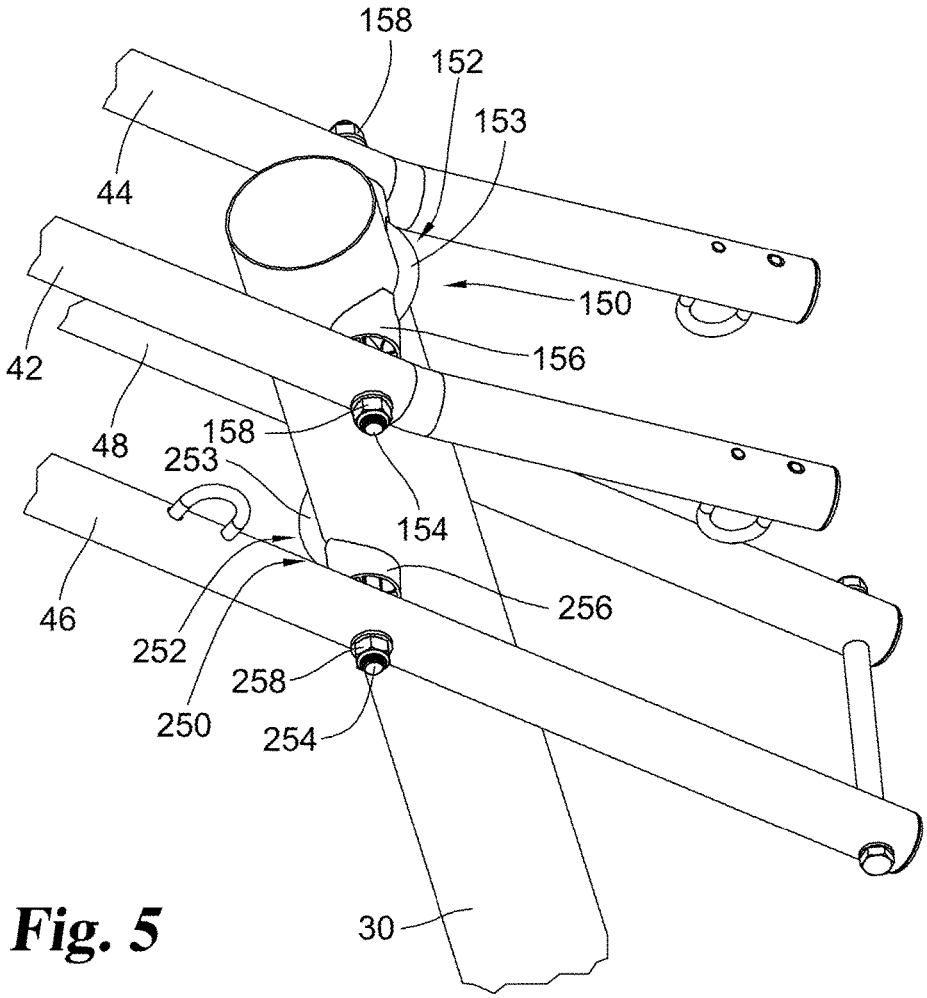
FIG. 5 is a perspective view of the support system attached to a support pole from the basketball goal of FIG. 1.

FIG. 5 shows a view of an upper attachment assembly 150 and a lower attachment assembly 250 connecting support arms 42, 44, 46, 48 to support pole 30. An upper attachment assembly 150 is positioned on support pole 30 and connects upper support arms 42, 44 to support pole 30. Medial portion 153 of upper attachment assembly 150 may be permanently secured to support pole 30 either by welding or another suitable form of permanent or semi-permanent attachment. For example, upper attachment assembly 150 may be affixed to support pole using screws, eyebolts, or a clamping mechanism. In certain embodiments medial portion 153 may be removable from support pole 30, but this is less preferred. Each bolt end 154 extends through a corresponding spacer 156 that is positioned on each side of medial portion 153. Each bolt end 154 then extends through an opening in a corresponding support arm 42, 44. A locking piece 158 is attached on each bolt end 154 of upper attachment assembly 150, so that each support arm 42 or 44 is retained between a locking piece 158 and a spacer 156. Appropriate washer elements may be used if desired.

A lower attachment assembly 250 is positioned on support pole 30 and connects upper support arms 46, 48 to support pole 30. Medial portion 253 of lower attachment assembly 250 is permanently secured to support pole 30 either by welding or another suitable form of permanent attachment or semi-permanent attachment such as screws, eyebolts, or a clamping mechanism. In other embodiments medial portion 253 may be removable from support pole 30, but this is less preferred. Similar to the upper attachment assembly 150, each bolt end 254 of lower attachment assembly 250 extends through a spacer 256 and then through an opening in a corresponding support arm 46, 48. A locking piece 258 is attached to each bolt end 254 so that support arm 46 and 48 is retained between a spacer 256 and a locking piece 258.

As seen in FIG. 5, the medial portions 153, 253 of upper bolt piece 152 and lower bolt piece 252 may be affixed to opposite sides of support pole 30. As an example, medial portion 153 of upper bolt piece 152 may be affixed to the rear side of support pole 30, facing away from backboard assembly 20. In contrast, medial portion 253 of lower bolt piece 252 may be affixed to the front side of support pole 30, facing toward backboard assembly 20. In certain embodiments, support pole 30 is arranged obliquely to the support surface, and bolt ends 154, 254 may be vertically aligned with respect to the support surface despite being positioned on different sides of support pole 30.

In other embodiments, the positions of upper attachment assembly 150 and lower attachment assembly 250 may be switched, so that upper attachment assembly 150 is permanently affixed to the front side of support pole 30 and lower attachment assembly 250 is permanently affixed to the rear side of support pole 30. Still other embodiments may have the medial portions 153, 253 of upper bolt piece 152 and lower bolt piece 252 both permanently affixed to front side of support pole 30 or both permanently affixed to the rear side of support pole 30. In most arrangements, bolt ends 154, 254 will be vertically aligned.

Also shown in FIG. 5, the curve of attachment assemblies 150, 250 may be less than 180 degrees so that bolt ends 154, 254 are offset from the center of support pole 30. In the embodiment shown, upper attachment assembly 150 is positioned on the rear side of support pole 30 and bolt ends 154 of bolt piece 152 are positioned rearward of the center of support pole 30. Conversely, lower attachment assembly 250 is positioned on the front side of support pole 30 and that bolt ends 254 of bolt piece 252 are positioned forward of the center of support pole 30. In other embodiments, attachment assemblies 150, 250 may curve or be shaped to extend 180 degrees around the support member so that bolt ends 154, 254 are positioned along a center plane of support pole 30. Alternately, attachment assemblies 150, 250 may extend around the support member to encompass more than 180 degrees.

Figure 6:
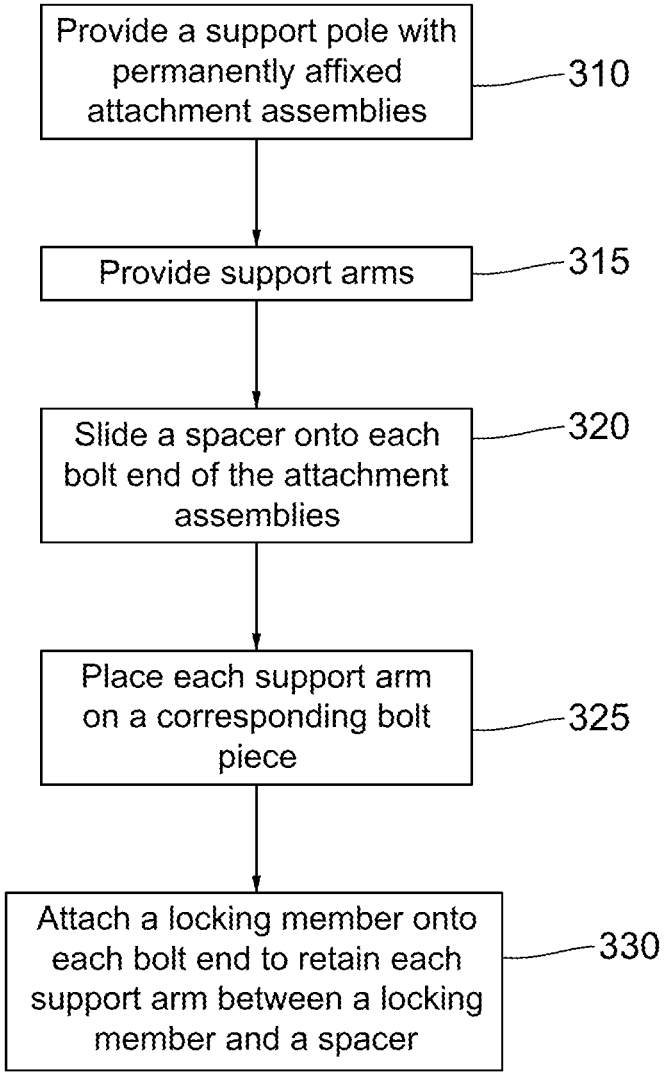
FIG. 6 is a flow chart for a method of mounting the support system of a basketball goal to the support pole of the basketball goal.

FIG. 6 is an example flow chart 300 depicting a method of mounting the support arms of a basketball goal to the support pole of the basketball goal. A support pole that has previously permanently affixed attachment assemblies is provided 310. Additionally, support arms with previously made openings are provided 315. Each attachment assembly is able to receive two support arms.

Optionally, a spacer is slid 320 onto each bolt end of the attachment assemblies. Each bolt end extends completely through an opening in a spacer. The support arms are then placed 325 on the bolt ends so that each bolt end extends through an opening in a corresponding support arm. A locking member is attached 330 to the outer portion of each of the bolt ends, retaining each of the support arms between a spacer and a locking member. The support arms are often attached so that they may pivot about the attachment assemblies, allowing adjustment of the height of the basketball goal by pivoting the support arms.

It should be understood that the order of events in flow chart 300 may be performed in a different order in other embodiments. For example, the entire process of sliding a spacer onto the bolt end, inserting the bolt end through a support arm and attaching a locking member may be completed for a single support arm and then repeated for each of the remaining support arms.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

The invention claimed is:

1. A basketball goal assembly, comprising:

a backboard assembly with a backboard;

a support pole having a width, a front side and a rear side and defining a vertical support axis parallel to said backboard;

an upper pair and a lower pair of support arms extending between said backboard assembly and said support pole, wherein said support arms pivotally attach said backboard assembly to said support pole;

an upper one-piece bolt, wherein said bolt has a medial rod portion and bolt ends extending from each side of said medial rod portion with said bolt ends axially aligned along a single axis and wherein said medial rod portion of said bolt is welded to said rear side of said support pole with said bolt ends protruding beyond the width of said support pole;

a lower one-piece bolt, and wherein said bolt has a medial rod portion and bolt ends extending from each side of said medial rod portion with said bolt ends axially aligned along a single axis and wherein said medial rod portion of said bolt is welded to said front side of said support pole with said bolt ends protruding beyond the width of said support pole;

wherein said upper pair of support arms is mounted on the respective bolt ends of said upper one-piece bolt with each bolt end extending through a respective support arm wherein the weight of said backboard assembly causes said upper pair of support arms to apply force to said upper one-piece bolt in a vector perpendicular to the vertical support axis; and, wherein said lower pair of support arms is mounted on the respective bolt ends of said lower one-piece bolt with each bolt end extending through a respective support arm wherein the weight of said backboard assembly causes said lower pair of support arms to apply force to said lower one-piece bolt in a vector perpendicular to the vertical support axis.

2. The basketball goal assembly of claim 1, wherein said support pole has a circular cross-section, and wherein said medial rod portion of said upper one-piece bolt is curved to match the curvature of said support pole and said medial rod portion of said lower one-piece bolt is curved to match the curvature of said support pole.

3. The basketball goal assembly of claim 1, further comprising a spacer positioned around each of said bolt ends between each medial rod portion and a respective support arm.

4. The basketball goal assembly of claim 3, wherein an inner surface of said spacer is shaped to match the shape of said support pole.

5. The basketball goal assembly of claim 1, further comprising a locking portion attached to each bolt end, wherein said locking portion is adapted to prevent said support arm from being removed from said bolt end.

6. The basketball goal assembly of claim 1, wherein said upper pair of support arms is mounted on opposing sides of the width of said support pole wherein a midpoint of the force applied by said upper pair of arms to said upper one-piece bolt is aligned with the midpoint of the support pole.

7. The basketball goal assembly of claim 6, wherein substantially the entire length of said medial portion of said upper one-piece bolt contacts the support pole.

8. The basketball goal assembly of claim 1, wherein said support pole has a circular cross-section, wherein said medial rod portion of said upper one-piece bolt is curved to match the curvature of said support pole and wherein substantially the entire length of said medial portion of said upper one-piece bolt contacts said support pole.

9. A basketball goal assembly, comprising:

a backboard assembly with a backboard;

a support member having a width, a front side and a rear side and defining a vertical support axis parallel to said backboard;

a pair of upper support arms extending between said backboard assembly and said support member;

a pair of lower support arms extending between said backboard assembly and said support member;

an upper one-piece bolt, wherein said bolt has a medial rod portion and a bolt end extending from each side of said medial rod portion with said bolt ends axially aligned along a single axis;

a lower one-piece bolt, wherein said bolt has two bolt ends and a medial rod portion between said bolt ends with said bolt ends axially aligned along a single axis;

wherein each of said upper support arms is mounted on a respective bolt end of said upper bolt and wherein each of said lower support arms is mounted on a respective bolt end of said lower bolt wherein the weight of said backboard assembly causes said upper pair of support arms to apply force to said upper bolt in a vector perpendicular to the vertical support axis and wherein the weight of said backboard assembly causes said lower pair of support arms to apply force to said lower bolt in a vector perpendicular to the vertical support axis;

wherein said medial rod portion of said upper bolt is welded to the rear side of said support member with said bolt ends protruding beyond the width of said support pole; and, wherein said medial rod portion of said lower bolt is welded to the front side of said support member with said bolt ends protruding beyond the width of said support pole.

10. The basketball goal assembly of claim 9, wherein said medial rod portions are shaped to match the shape of said support member.

11. The basketball goal assembly of claim 9, wherein said support member has a circular cross-section and said medial rod portions are curved to match the curvature of said support member.

12. The basketball goal assembly of claim 9, wherein said support member is mounted to a portable base.

13. A basketball goal assembly, comprising:

a backboard assembly with a backboard;

a support pole having a width, a front side and a rear side and defining a vertical support axis parallel to said backboard;

a pair of upper support arms extending between said backboard assembly and said support pole, wherein said support arms attach said backboard assembly to said support pole;

a pair of lower support arms extending between said backboard assembly and said support pole, wherein said support arms attach said backboard assembly to said support pole;

an upper one-piece bolt, wherein said upper bolt has two bolt ends and a medial rod portion welded to a rear surface of said support pole, said medial rod portion being between said bolt ends with said bolt ends axially aligned along a single axis wherein the weight of said backboard assembly causes said upper pair of support arms to apply force to said upper one-piece bolt in a vector perpendicular to the vertical support axis;

a lower one-piece bolt, wherein said lower bolt has two bolt ends and a medial rod portion welded to a front surface of said support pole, said medial rod portion being between said bolt ends with said bolt ends axially aligned along a single axis wherein the weight of said backboard assembly causes said lower pair of support arms to apply force to said lower one-piece bolt in a vector perpendicular to the vertical support axis;

wherein each of said support arms is mounted on a respective bolt end; and, wherein said support pole has a curved cross-section and said medial rod portions are curved to match the curvature of said support pole.

14. The basketball goal assembly of claim 13, wherein said support arms are parallel.

15. The goal assembly of claim 13, wherein the axis defined by said bolt ends of said upper bolt and wherein the axis defined by said bolt ends of said lower bolt are parallel and vertically aligned.

16. The goal assembly of claim 13, wherein said support pole is mounted to a portable base.

* * * * *